US005408775A

United States Patent [19]

Abramson et al.

[11] Patent Number: 5,408,775

[45] Date of Patent: Apr. 25, 1995

[54] MERCHANDISE INFORMATION SYSTEM

[75] Inventors: Patrick B. Abramson, Brampton, Canada; Peter B. Stewart, Dallas, Tex.

[73] Assignee: VIDPRO International, Inc., Dallas, Tex.

[21] Appl. No.: 97,310

[22] Filed: Jul. 23, 1993

Related U.S. Application Data

[63] Continuation of Ser. No. 693,692, Apr. 30, 1991, abandoned.

[51] Int. Cl.[6] ..... G09F 3/18

[52] U.S. Cl. ..... 40/642; 40/650; 24/576

[58] Field of Search ..... 40/649, 651, 657, 661, 40/642, 531, 124, 124.4, 617, 399, 400, 650; 24/576, 462; 383/62, 65, 95

[56] References Cited

U.S. PATENT DOCUMENTS

| | | | |
|---|---|---|---|
| 402,024 | 4/1889 | Lomos | 24/462 X |
| 737,062 | 8/1903 | Bennett | 24/462 X |
| 4,603,434 | 7/1986 | Herrington | 383/95 |
| 4,682,825 | 7/1987 | Crosslen | 40/650 X |
| 4,793,495 | 12/1988 | Preu | 211/46 X |
| 4,821,437 | 4/1989 | Abramson et al. | 40/642 |
| 4,935,995 | 6/1990 | Daus, Jr. | 24/573.1 |
| 5,088,164 | 2/1992 | Wilson et al. | 24/576 |

FOREIGN PATENT DOCUMENTS

| | | | |
|---|---|---|---|
| 1812 | of 1904 | United Kingdom | 160/392 |

*Primary Examiner*—Kenneth J. Dorner
*Assistant Examiner*—Cassandra Davis
*Attorney, Agent, or Firm*—David H. Judson

[57] ABSTRACT

A merchandise information system having a plurality of display items each having on opposite sides thereof information concerning available merchandise at a remote location. The system includes a support having a rigid base, and a plurality of spaced flexible webs formed integral with the lower edge of the base and depending therefrom. The display items are attached to the lower ends of the webs to display one side of the item. The lower end of each web includes a "claw" structure to prevent theft of the display item through downward extraction of the item from the web. A locking bar underlies the support for preventing the display items from being removed laterally from the web.

2 Claims, 3 Drawing Sheets

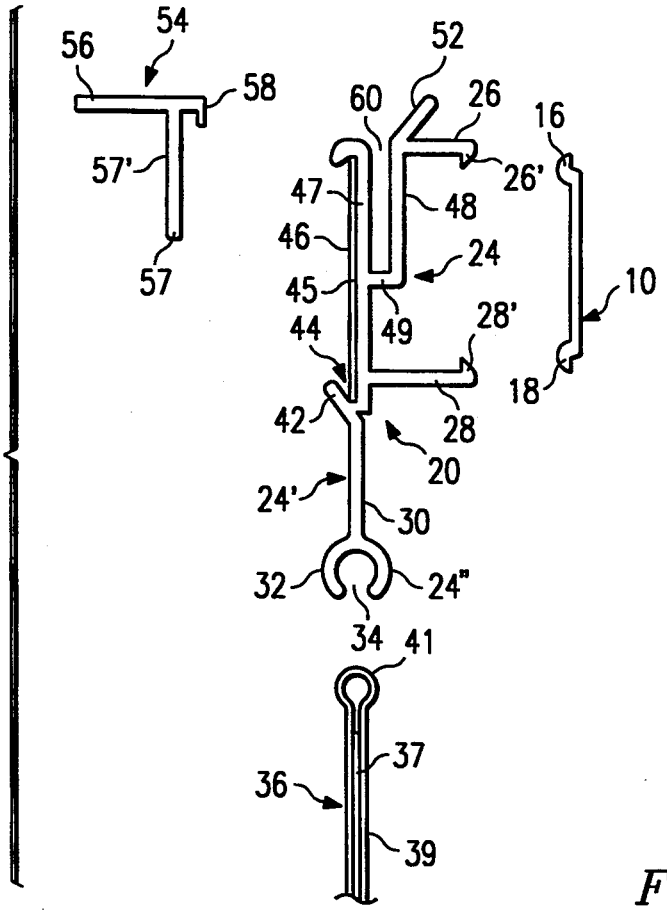
FIG. 2.
FIG. 3
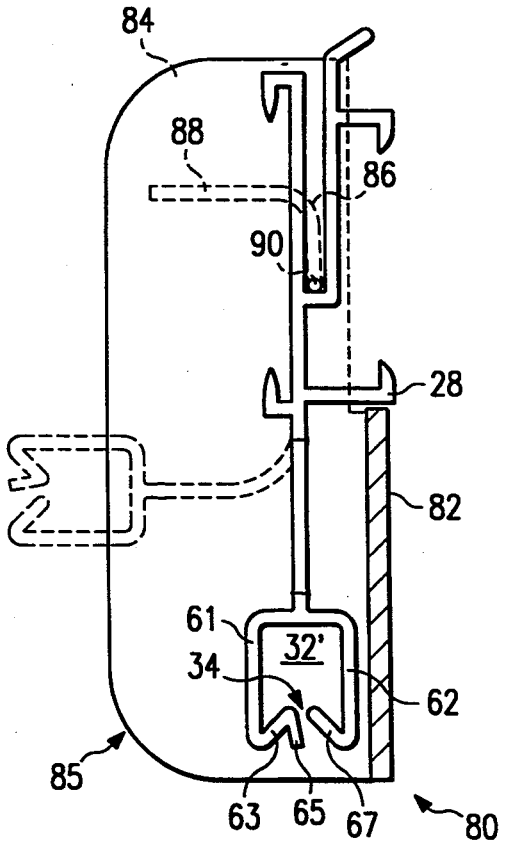
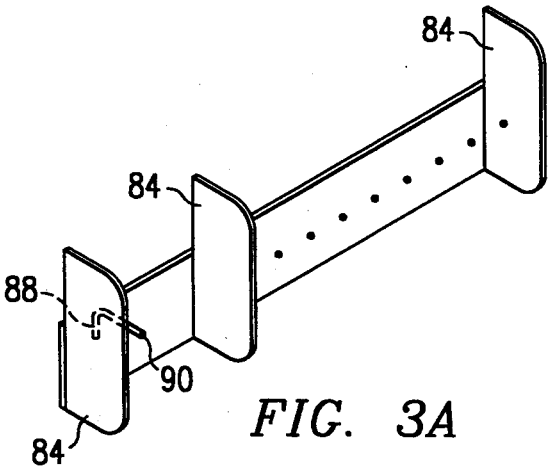
FIG. 3A

MERCHANDISE INFORMATION SYSTEM

This is a continuation of application Ser. No. 07/693,692 filed on Apr. 30, 1991, now abandoned.

TECHNICAL FIELD

The present invention relates to merchandising systems and improvements therefor particularly adapted for displaying product information items.

BACKGROUND OF THE INVENTION

Attractive, open display of an abundance of merchandise, conducive of favorable purchasing decisions whether or not a patron is assisted by a salesperson, is potentially at odds with limiting inventory costs, reducing the amount of warehousing and other handling, controlling pilferage, and limiting losses attributable to shop worn or out-of-date merchandise. A variety of responses have occurred in response to these problems.

One direction taken has been to install an increasing number of security systems at the retail location including means of surveillance and alarm systems. This however, addresses only the problem of shrinkage attributable to pilferage and tends to create an atmosphere of distrust not conducive to selling.

Another direction taken has been toward limiting the merchandise displayed, as for example in the number of catalog showrooms that have arisen in recent years. This tackles the problems of inventory size, handling, and losses due to out-of-date merchandise, while usually exposing only a single item to wear-and-tear or possible theft while on showroom display.

The above-identified problems have been solved through the use of merchandise information systems as described in U.S. Pat. No. 4,821,437 to Abramson, et al. The system described in that patent, which is assigned to the assignee of this application, eliminates the need for exhibition of the merchandise to the public at the retail location, but instead affords information via display of production information modules, i.e., cards, packets, or similar tactile elements of durable design and material that attractively advertise availability of the product at that outlet and inform the clientele with respect to the product. It substitutes mass display of each item carried with mass display of such information modules, in an array providing high density but individually visible display. It also substitutes physical examination of a particular sample with physical manipulation of the product information module, but without requiring a comparable level of handling by store personnel and without required dedication of a comparable amount of floor space.

In the Abramson, et al. patent, the system includes support means for holding information display means in the form of items or modules having information on front and back sides thereof in high density but individually visible concentration while allowing each and any module to be manipulated by a prospective customer for ready visual access to all the information provided thereon. The support means comprise an extrusion with which the information display means is so associated that the information is readily accessible. In a preferred embodiment disclosed in the Abramson, et al. patent, the support means includes flexible attachment means for permitting the manipulation of the information display means. The support means can be an elongate extrusion mountable on a wall or other surface in a position to allow viewing of the information display means or product information modules. The support means comprises a relatively rigid support having the flexible attachment means connected thereto. The flexible attachment means preferably comprises a plurality of flexible strips extending from the support and having free ends that terminate in attaching means adapted to grip the information display means.

One class of merchandise for which the system disclosed in U.S. Pat. No. 4,821,437 is particularly adapted is that of prerecorded video tapes. Presently tapes of concerts, motion pictures, or the like are distributed with a cassette housing provided with pictures and other labelling that identify the contents, artists, producers, and such other possible aids to selection as plot synopsis, critical acclaims, and awards. A retailer may store the cassette packages on shelves accessible to the public or maintain them behind a counter, in which case the sales impact of the labelling is substantially reduced. If offering the tapes for rent, the cassette is often removed and the housing only displayed on shelving, requiring that the housing be brought to the checkout counter and tape and housing matched. The alternative practice of openly displaying cassette and housing together, or perhaps cassette with specialized housing, requires a good deal of confidence in the store's other security measures. All of the above practices have drawbacks that are overcome by such application of time, space or restrictive practices that purveying of such tapes has been primarily limited to speciality stores.

Application of the system disclosed in the Abramson, et al. patent permits attractive displays for many different types of products including video cassettes marketed with or without cassette housings, compact disks and even houses (e.g., in a real estate office). In the tape store application, information that went on the housing package is now placed on the product information module, employing space on the front and back of the module. A customer makes his selection at the array presented, being able to view the modules, read information contained thereon front or back by turning it on its hinge, and obtain his selection at the checkout having access to the actual cassette.

While the novel merchandise system of Abramson, et al has significant advantages over the prior art, it has now been found desirable to enhance the security of such systems to prevent theft of the information display cards.

BRIEF SUMMARY OF THE INVENTION

It is therefore an object of the present invention to provide a merchandise information system having an array of information display cards or packets which includes means for preventing theft of the individual display items.

It is another object of the present invention to provide a novel display item construction for use in such a merchandise system that has a pocket for supporting product information graphics cards.

It is a further object of the invention to provide a packet construction that facilitates storage of such information display cards.

The invention relates to improvements to a merchandise information system having a plurality of display items each having on opposite sides thereof information concerning available merchandise at a remote location. The system includes a support having a rigid base, and a plurality of spaced flexible webs formed integral with the lower edge of the base and depending therefrom. The display items are attached to the lower ends of the webs to display one side of the item. The lower end of each web includes a "claw" structure to prevent theft of the display item through downward extraction of the item from the web. A locking bar underlies the support for preventing the display items from being removed laterally from the web.

The foregoing has outlined some of the more pertinent objects of the present invention, These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 2 is an exploded end view of elements of the display system of FIG. 1;

FIG. 3 is an exploded end view of an alternate embodiment of the display system of FIG. 2 according to the present invention;

Similar reference characters refer to similar parts throughout the several views of the drawings.

DETAILED DESCRIPTION

Figure 1:
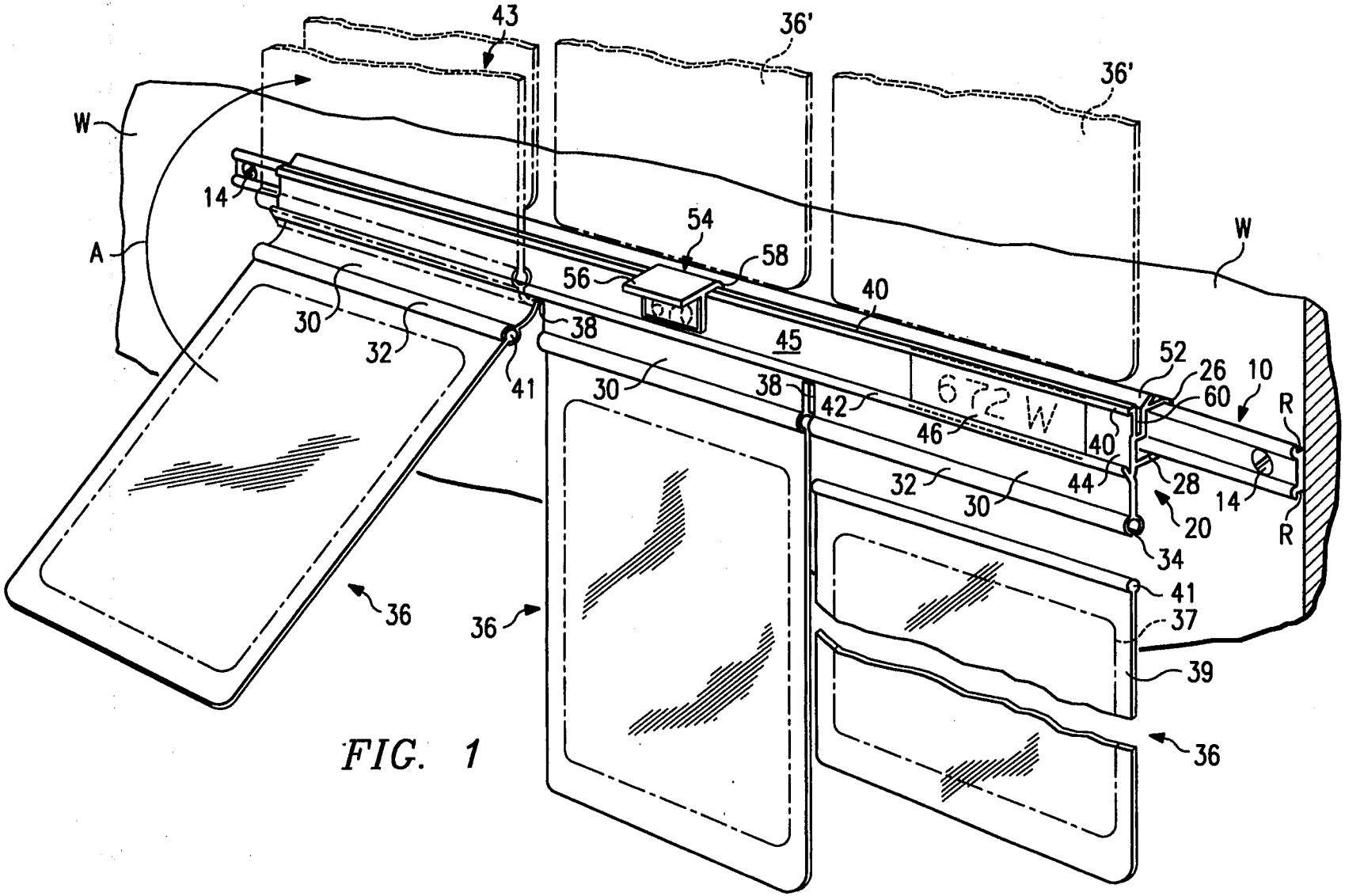
FIG. 1 is a perspective view of part of a merchandise information display system.

Reference is now made to FIG. 1 of the drawings which shows part of an information display system in accordance with the teachings of U.S. Pat. No. 4,821,437. A rail 10 made of synthetic resin or plastic material is secured to a wail W by horizontally spaced screws 14. With additional reference to FIG. 2, the rail 10 has integral upper and lower ribs 16 and 18 respectively which define spaces or recesses R between such ribs 16, 18 and the wall W into which the lips 26' and 28' of the support means 20 are snapped or slid. The support means 20 is of relatively complex cross-section, being extruded into such form and having different portions 24, 24' and 24'' possessing different mechanical properties for reasons which will be explained hereinafter.

The portion 24 includes the upper and lower flanges 26 and 28 having the aforesaid lips 26' and 28' which are received in the spaces R, R. The flanges are spaced apart so as respectively to snap fit over the ribs 16 and 18 of the plastic rail 10. The portion 24 is made of relatively rigid plastic or synthetic resinous material and is extruded integrally with the portion 24' which is relatively flexible and is in turn extruded integrally with the portion 24''. The portion 24'' is less flexible than the portion 24' but more flexible than the portion 24.

The portion 24 forms an elongate support for an array of the product information display means 36 so that a prospective customer may view the information on the front side of each item attached to the support 24. Each display means is capable of being manipulated by swinging it upwardly as indicated by the arrow A to the dotted line position 43, the information on the reverse side of the means 36 then being accessible to the prospective customer. The flexible attachment means provided by the portions 24' and 24'' permit this manipulation. It will be noted that portion 24' comprises a flexible member 30 in the form of a web. The portions 24' and 24'' are divided into a plurality of individual attachment means that extend serially the length of the support 24, cumulatively commensurate in length with the support 24 and accordingly of an individual length fractional thereto. The notches 38 separate the individual attachment means, formed of the aforesaid portions 24' and 24'', each from its neighboring individual attachment means. It will be apparent that the notches 38 are made after extrusion of the continuous support means 20. The free ends of the individual attachment means 24'' are formed into tubular clips 32 of C-shaped cross sections provided by the slots 34 extending the length of each clip 32.

Each product information display means 36 is of generally rectangular configuration and comprises a graphics card 37 or two such graphics cards or sheets which provide all the requisite information about the video tape, which graphics cards are enclosed or encased in the clear plastic envelope 39. The side or fact of the display means 36 which is normally exposed to the customer's view will usually be provided with the title and an attractive picture and the reverse side of the display means facing the wall will usually be provided with more detailed information about the corresponding video tape. The plastic envelope 39 can be sealed to provide the information display means in packet form. Further, this packet includes the tubular bead 41 which is slightly larger in diameter than the interior of tubular clip 32. When the bead 41 is inserted into the tubular clip 32 either by forcing it through the slot 34 or by sliding it lengthwise into the clip 32, an attachment between the product information packet 36 and support means 20 is effected which permits the packet to be manipulated so that its reverse side may be viewed by the prospective customer, as permitted by flexure of the flexible portion 24'. The spacing of the notches 38 and lengths of the tubular clips 32 is limited to the width of the packets 36, to allow each packet to be manipulated without interfering with the orientation of neighboring packets or information display meads.

In FIG. 1, it will be appreciated that, because each information display means 36 is swung upwardly such as indicated by reference character 43, information on the back of the packet will have to lie head to toe to that on the front of the label to permit it to be easily read. Also, it will be noted that when the packet is released, it will simply fall to the original position as shown by the central display means 36 in FIG. 1. If for any reason a particular display means 36 must be replaced, same may be done either by snapping it out of its tubular clip 32 with a sharp pull or by sliding it out lengthwise of the clip 32. Another display means 36 may then be slid or snapped into the clip 32, and thus may the product information display means 36 be replaced or rearranged at will.

In order to assemble the display system, the rails 10 are first spaced apart vertically at a distance such that when the product information means 36 are mounted, each such means can be freely raised to view its reverse side. Once the spacing has been set and the rails 10 secured, the support means 20 is cut to size and slid into place. The product information modules can next be sorted and arranged and then inserted into their appropriate positions by use of the tubular clips 32. Finally, other labelling or indicia 46 may be applied to the surface 45. In addition or alternatively, product identification label carriers 54 may be used. FIG. 2 illustrates the construction of such carriers wherein it will be seen that each carrier comprises a vertical web 57 providing a front surface 57' to which the labelling may be applied, a front overhand 56 for ease of grasping, and a hook portion 58 which allows the carrier to be hung over the top edge of the web 47. The carriers may be taken by a customer and handed in to the sales clerk.

The front side of the elongate support 24 is provided with two forwardly projecting and mutually convergent ribs, 40 and 42, that define, with the front face 45, a wide shallow channel 44 extending the length of the support means 20 and within which labels such as indicated at 46 can be placed to contain further information such as identification of the product advertised by a corresponding display means 36.

Still referring to FIGS. 1 and 2, the upstanding portion 48 is joined to the web 47 by the bight 49 to define an upwardly opening channel 60, said channel being dimensioned so that additional product information means 36 or other ancillary display information may be inserted thereinto. The ramp 52 projects upwardly and rearwardly from the upper edge of the portion 48 to assure easy insertion of such elements into the channel 60.

Various modifications may be made to the embodiments described. The invention may be practiced in display, information, or exhibit contexts other than a retail outlet. The support means could be secured other than through a cooperative rail element. Orientations other than horizontal may be employed. Surfaces to which the system is attached may have fixed, moveable, or other characteristics. For example, the support elements for modules below a comfortable viewing height could be suspended on vertical strips formed of a flexible material so that they could be lifted to examine modules attached thereto. In addition, attachment means other than tubular clips could be employed.

For example, and with reference now to FIG. 3, one such alternate construction is shown. In this embodiment, the free ends of the individual attachment means 24" are formed into "claw-like" clips 32' of rectangular cross sections provided by the slots 34 extending the length of each clip 32'. Each clip 32' includes first and second sides 61 and 62. Side 61, located away from the support wall, has an upwardly-extending retaining edge 63 that terminates in a downwardly-extending alignment lip 65. Alignment lip 65 presses against the face of the display item to insure that all of the display items lay with substantially the same orientation. Side 62 has an upwardly-extending retaining edge 67 that corresponds to the edge 63 of the side 61. The edges 63 and 67 extend upwardly to form the slot 34 and advantageously prevent the packet from being removed from the system through a downward pull. When the clip 32' is used, the packet can only be removed by sliding it out lengthwise of clip 32'.

Such lengthwise removal of the packet is prevented (or limited to those having authority to do so) through the use of a locking means designated generally by the reference numeral 80. The locking means comprises a locking bar 82 that preferably extends the length of the rail 10. The locking bar 82 underlies the flange 28 and includes a plurality of spaced locking plates 84, one of which is shown in FIG. 3. Each of the locking plates 84 is supported in one of the notches 38 located between the individual attachment means. The locking plate 84 has a semicircular-shaped profile 85 such that, as the attachment means is rotated upwards (as shown in phantom), no portion of clip 32' is entirely free from the peripheral edge of the plate 84. Thus, as long as the locking means is retained on the rail, the individual pockets cannot be removed either downwardly (because of the claw-like clip 32') or laterally. This construction advantageously prevents theft of the individually display packets.

The locking bar is retained using a spring 86 on each of the outer end plates. Referring to FIG. 3, the locking plate 84 is shown as the end plate and includes the spring having a first portion 88 supported within or against the end locking plate. A second portion 90 of the spring 86 is retained in the slot 60 to retain the locking bar in the rail. To remove the locking bar, the end locking plate is pulled laterally away from the fixed rail.

Figure 4A:
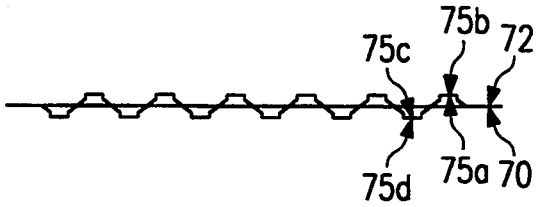
FIG. 4A is a plan view of the display means of FIG. 4.
Figure 4:
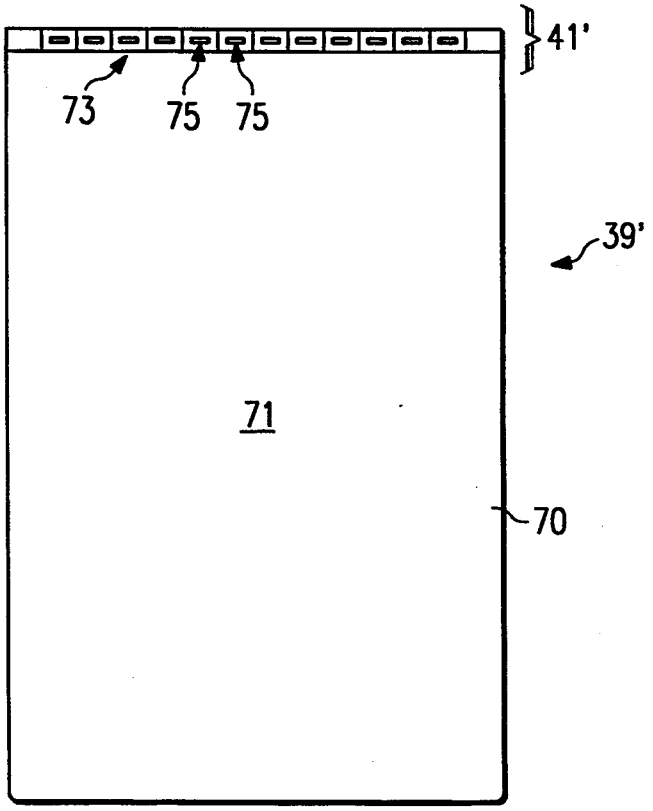
FIG. 4 is an elevation view of an alternate construction of the individual product information display means according to the present invention.

Referring now to FIGS. 4 and 4A, each of the information display means 36 may alternatively comprise a plastic envelope 39' that, rather than being sealed, is formed of two sheets 70 and 72 sealed around their bottom and side edges to form a pocket 71 within the envelope. The pocket supports the graphics card 37 as previously described. With this construction, the graphics card 37 can be readily exchanged by the store personnel to increase the flexibility of the system. Each of the sheets 70 and 72 has a crimped upper edge 73 comprising a plurality of inwardly- and outwardly-directed projections 75. After the graphics card is inserted, the upper edges of each of the sheets 70 and 72 are pressed together to seal the packet. In particular, the first inwardly-directed projection **75*a* of sheet 70 mates with the corresponding outwardly-directed projection 75*b* of sheet 72, the first inwardly-directed projection 75*c* of sheet 72 mates with the corresponding outwardly-directed projection 75*d* of sheet 70, and so forth. The bead 41' of the plastic envelope 39'** thus has an alternating crimped configuration, which enhances the ease with which the individual packets can be stacked on top of each other for storage and shipment.

Figure 5:
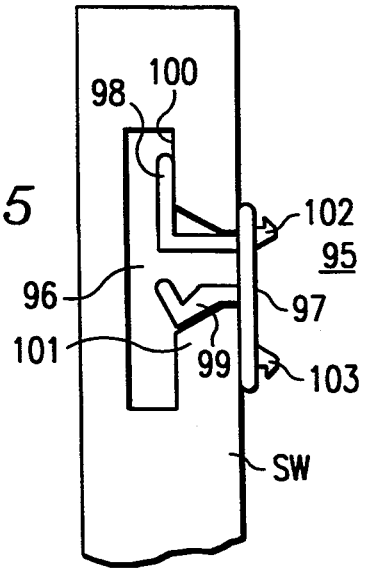
FIG. 5 is a side view of an alternate embodiment of the invention wherein the system is attached to a slotwall through an adapter.

FIG. 5 shows an alternate embodiment of the invention wherein the rail 10 is supported on a slotwall adapter anchor 95 that is retained within a slot 96 of a slotwall SW. The anchor 95 includes a base 97 to which first and second legs 98 and 99 are attached. First leg 98 is right-angled and is received within the slot 96 for retaining the anchor 95 against the upper retaining edge 100. Second leg 99 has a slightly v-shaped distal end which abuts the flange 101 along the lower portion of the slot. Upper and lower flanges 102 and 103 of the anchor 95 are received in the ribs 26' and 28' of the rail to retain the rail on the anchor.

It should be appreciated by those skilled in the art that the specific embodiments disclosed above may be readily utilized as a basis for modifying or designed other structures for carrying out the same purposes of the present invention. It should also be realized by those skilled in the art that such equivalent constructions do not depart from the spirit and scope of the invention as set forth in the appended claims.

What is claimed is:

1. A merchandise identification system comprising a plurality of display items and support means for holding said items in closely spaced high density concentration relative to one another so as to be individually visible while allowing each and every item to be manipulated by a customer to provide ready visual access to all information on opposite sides of the item, said support means including a first portion of relatively rigid material having means thereon for mounting the support means in operative position, said support means having a second portion of relatively flexible material integral with said first portion and extending along a length thereof, said second portion comprising a plurality of adjacent flexible webs, said webs having adjacent side edges spaced from one another by notches, each of said webs having at a lower edge thereof attaching means for attaching said display items thereto in depending relationship therefrom so that one side of the display item is visible to a customer, the flexible webs permitting a customer to swing each display item upwardly about its associated flexible web to permit the customer to view an opposite side of the display item, the improvement comprising:

means for preventing the display items from being removed from the support means, wherein the means for preventing comprises a locking bar underlying the first portion of the support means, the locking bar having a plurality of spaced locking plates supported in the notches between adjacent flexible webs;

wherein the attaching means includes means for preventing the display item from being pulled out therefrom in a predetermined direction, and wherein the means for preventing of the attaching means includes first and second sides each having an upwardly and inwardly-directed edge, the upwardly and inwardly directed edge of the first side further including an outwardly-extending alignment lip to maintain the display item in a predetermined orientation.

2. A merchandise identification system comprising a plurality of display items and support means for holding said items in closely spaced high density concentration relative to one another so as to be individually visible while allowing each and every item to be manipulated by a customer to provide ready visual access to all information on opposite sides of the item, said support means including a first portion of relatively rigid material having means thereon for mounting the support means in operative position, said support means having a second portion of relatively flexible material integral with said first portion and extending along a length thereof, said second portion comprising a plurality of adjacent flexible webs, said webs having adjacent side edges spaced from one another by notches, the flexible webs permitting a customer to swing each display item upwardly about its associated flexible web to permit the customer to view an opposite side of the display item, the improvement comprising:

attaching means at a lower edge of each of said webs for attaching said display item thereto in depending relationship therefrom so that one side of the display item is visible to a customer, wherein the attaching means includes means for preventing the display item from being pulled out therefrom in a predetermined direction; and wherein the means for preventing includes first and second sides each having an upwardly and inwardly directed edge, the upwardly and inwardly directed edge of the first side further including an outwardly-extending alignment lip to maintain the display item in a predetermined orientation.

* * * * *